United States Patent [19]

Wendt

[11] 4,223,494

[45] Sep. 23, 1980

[54] DOORFRAME ASSEMBLY FOR PARTITION WALL CONSTRUCTION

[75] Inventor: Alan C. Wendt, Barrington, Ill.

[73] Assignee: United States Gypsum Company, Chicago, Ill.

[21] Appl. No.: 28,296

[22] Filed: Apr. 9, 1979

[51] Int. Cl.[3] ..... E06B 1/04

[52] U.S. Cl. ..... 52/211; 49/504; 52/741

[58] Field of Search ..... 52/211–217, 52/741; 49/399, 460, 504, 505, 506

[56] References Cited

U.S. PATENT DOCUMENTS

| | | | |
|---|---|---|---|
| 3,222,833 | 12/1965 | Woodrum | 52/211 |
| 3,287,856 | 11/1966 | Passovoy | 49/504 |
| 3,320,705 | 5/1967 | Downing | 52/214 |
| 3,354,586 | 11/1967 | Den Besten | 49/504 |
| 3,401,487 | 9/1968 | Brandt et al. | 49/504 |
| 3,469,350 | 9/1969 | Lange | 49/504 |
| 3,473,265 | 10/1969 | Norman et al. | 49/504 |
| 3,609,928 | 10/1971 | Mock | 52/214 |
| 3,654,734 | 4/1972 | Lehman | 52/212 |
| 3,681,876 | 8/1972 | Linder et al. | 49/504 |
| 3,774,345 | 11/1973 | Cole et al. | 49/504 |
| 3,886,688 | 6/1975 | Ragland | 49/504 |
| 3,924,373 | 12/1975 | Lizdas et al. | 52/213 |
| 4,034,513 | 7/1977 | Richardson | 49/504 |
| 4,034,514 | 7/1977 | Cecil | 49/504 |

*Primary Examiner*—James L. Ridgill, Jr.

*Attorney, Agent, or Firm*—Glenn W. Ohlson; Robert H. Robinson; Kenneth E. Roberts

[57] ABSTRACT

A doorframe assembly for partition wall construction is disclosed and comprises metal backer jamb members adapted for attachment to opposite sides of a door opening, vinyl jamb members snap-engaged with the metal backer jamb members, hinge plate means for supporting a door attached along a longitudinal recess portion of a vinyl jamb member at one side of the door opening, strike plate means adapted for receiving door locking means attached along a longitudinal recess of a vinyl jamb member at the opposite side of the door opening, and, mortising vinyl trim adhered along remaining open portions of the vinyl jamb members at both sides of the door opening and having a thickness substantially the same as the hinge plate means and strike plate means providing a mortised generally planar finished surface along the vinyl jamb members.

21 Claims, 7 Drawing Figures

DOORFRAME ASSEMBLY FOR PARTITION WALL CONSTRUCTION

THE BACKGROUND OF THE INVENTION (1) Field of the Invention

The invention relates to a doorframe assembly for a door opening in hollow wall partition construction wherein the assembly comprises metal backer jamb members snap-engaged by vinyl jamb members which envelop and cover the metal backer jamb members and provide longitudinal recess means for attaching hinge plate means and strike plate means whereby vinyl mortising trim members are adhered at remaining open portions of said longitudinal recess means to provide a generally planar finished surface along the vinyl jamb members. A method for framing a door opening in a hollow wall partition construction is also disclosed.

(2) Description of the Prior Art

Hollow partition wall construction featuring quick installation and field adaptability to particular construction requirements has become very desirable in recent years. Along with this hollow wall construction, framing for door openings must also allow for ease of installation with members that can be interchangeably used as particular needs arise in an overall office, residence, or factory partition wall system. It has become particularly important to provide framing members which can be interchangeably used and individually altered in the field.

Many prior art door frame techniques utilize extruded metal and vinyl elements to provide required quick installation. Typically, an exposed extruded jamb member provides slotting or notching for hinge members, securing plate members, door stops, trim plates, strike plates, and an array of necessary hardware elements for door framing. Unfortunately, many prior systems either restrict attachment of hinge plates to only one jamp member and a strike plate to an opposing jamb member at the other side of the door opening. Also, some systems have large assortments of accessory parts that involve lengthy installation operations for their attachment. It would be desirable to provide door framing members which allow reversibility of jamb members with a limited number of accessory parts that would expedite installation and allow interchangeability of members having equally adaptable use at various door openings without limitation to a specific door opening location in a hollow wall partition construction.

It has also become a need of the construction industry to provide a door jamb member which permits the variable location of hinge plates without limitation to specifically notched portions. In attempting to solve this problem, past attempts have typically been limited to connection of hinge plates with metal members. With increased costs of providing decorative exposed metal jamb members the use of extruded vinyls has been explored. Problems, however, have arisen when trying to incorporate extruded vinyl members in that attachment to door opening sides necessitates the use of a sturdy metal backer of some sort. Complex shapes for metal backer jambs have thus been required allowing versatile location of hinge plate means. The hinge plate attachment is then followed by attachment of numerous extruded trim elements concealing unsightly and undecorated metal backer jambs. In many attempted solutions, a difficulty has arisen in providing the necessary thickness of metal backer members that feature surfaces usable with screw fasteners for affixation of hinge plate means to afford necessary strength for door support. Although hollow-core doors reduce weight and thus alleviate the requirement of extra strength if a solid-core door is used, it would be highly desirable to have adaptability for use with a hollow-core or solid-core door in a hollow wall partition construction where needed. Conventional solid-core doors may range up to about 100 lbs. and sufficient strength of screw fastener attachment at hinge plate means is mandated. Efforts to provide this have been made wherein additional metal plates, shims, or plate means are inserted along a metal backer jamb behind hinge plate means to provide the necessary thicknesses for the conventional screw fastener attachment of hinge plate means involving the use of a heavier door.

At the side of a typical door opening where strike plate means coact with door locking means, a similar problem for allowing variable location of the strike plate has been confronted. In many recent attempts, the jamb at the strike side of the door opening requires a different shape and manner of installation than the jamb at the hinge side of the door opening. Moreover, pre-cut notches for attachment of a strike plate means necessarily limits the ability to provide members at various door locations having different strike plate height requirements. In previous solutions to reversible jamb member framing, there has typically been provided a complex jamb member which allows for use at either side of the door opening, but requires additional material for extruding, or roll forming, cover plate members and engageable slots on jamb members to attain this feature.

It would be desirable to provide a simplified framing utilizing reversible jamb members with facile installation and few elements.

(3) Objects of the Invention

It is a primary object of this invention to provide a doorframe for hollow wall partition construction which permits field installing hinges and strike plates along a jamb member at any location for either right-hand or left-hand swinging doors.

It is additionally an object of this invention to provide vinyl trim strips which are field applied adjacent hinges and above and below strike plate members, providing relatively quick and easy field installation.

It is additionally an object of this invention to provide a snap-on engaging vinyl jamb member which snap-engages a metal backer jamb member.

An important object of this invention is to provide metal backer jamb members and snap-engageable vinyl jamb members interchangeably usable at both sides of a door opening in a hollow-wall partition construction.

A concomitant goal of this invention is to provide attachment means along a metal backer jamb member capable of supporting both hollow-core and solid-core door members by hinge means fastened thereto.

A related object of this invention is to provide a simple method for installing a doorframe in a door opening of a hollow-wall partition construction wherein right-hand or left-hand swinging doors may be accommodated with variably located hinge means.

Another important object of this invention is to provide a door frame assembly, which consists of relatively few elements, allowing simple installation and low-cost manufacture.

SUMMARY OF THE INVENTION

In carrying out principles of the invention in accordance with a preferred embodiment thereof, a reversible doorframe assembly usable with right-hand and left-hand swinging doors comprises metal backer jamb members adapted for attachment to opposite sides of the door opening. The metal backer jamb members have substantially the same structural shape wherein two L-shaped elements are rigidly connected along overlapped leg portions of the L-shape to form a generally U-shape. The metal backer jambs additionally have free legs of the L-shaped elements adapted for fastening at opposite wall face surfaces adjacent the door opening. The free legs terminate in lip portions. At least one metal backer jamb member additionally comprises cutouts located along the overlapped leg portion at predetermined distances from opposite ends of the member. The doorframe assembly additionally comprises vinyl jamb members snap-engaged with the metal backer jamb members wherein the vinyl jamb members are of substantially the same structural shape, having a generally U-shape comprising a body portion covering the overlapped legs of the L-shaped members of the metal backer members and a centrally located upraised doorstop portion along the body portion. Said body portions also having longitudional recess portions thereon. Additionally, the body portion of the vinyl jamb member has flanges extending from opposite ends thereof, which terminate in inturned nib portions snap-engaging the lip portions of the metal backer jamb member whereby the metal backer jamb member is enveloped by the vinyl jamb member. In accordance with the preferred embodiment of the invention, the doorframe assembly additionally comprises hinge plate means for supporting a door wherein the hinge plate means are attached along the longitudinal recesses of a vinyl jamb member at one side of a door opening. At the other side of the door opening, a strike plate means for receiving door locking means is attached in positional correspondence with a cut-out portion of the metal backer jamb member along the longitudinal recess of a vinyl jamb member. Mortised vinyl trim is adhered along remaining open portions of the longitudinal recesses of the vinyl jamb members wherein the vinyl trim has a thickness substantially the same as the hinge plate means and strike plate means to provide a mortised generally planar finished surface along the vinyl jamb member.

Consistent with the principles of this invention, door framing for use in a hollow-wall partition construction having two spaced-apart rows of wall panels with opposite wall face surfaces is provided. The door framing provides in combination: a door opening in the hollow-wall construction having vertical stud members positioned adjacent opposite sides of the door opening; metal backer jamb members at opposite sides thereof; vinyl jamb members snap-engaged to the metal backer members; hinge plate means attachable along either side of the door opening along a vinyl jamb member; strike plate means attached along the vinyl jamb member at the opposite side; mortising vinyl trim adhered along the vinyl jamb members at remaining open portions of the longitudinal recesses providing a mortised, generally planar finished surface; and, a door member supported within said door opening by hinge means connective attachment to the hinge plate means.

In consonance with the invention, a method of installing a reversible doorframe assembly in a hollow-wall partition construction having vertical stud members adjacent opposite sides of a door opening and header means across the top of the opening is provided. The method comprises attaching generally U-shaped metal backer jamb members having substantially the same structural shape to opposite sides of the door opening. The method additionally comprises snap-engaging generally U-shaped vinyl jamb members having substantially the same structural shape over said metal backer jamb members. The method includes attaching hinge plate means along a longitudinal recess portion of a vinyl jamb member at one side of the door opening. A step is additionally provided for removing a cut-out slot on a longitudinal portion of a vinyl jamb member opposite the hinge means side of the door in positional correspondence with a cut-out portion of a metal backer jamb member and attaching strike plate means at the cut-out portions. A step is provided including adhering vinyl mortising trim along the longitudinal recesses of the vinyl jamb members at remaining open portions wherein the trim has a thickness substantially the same as the hinge plate means and strike plate means thereby providing a substantially planar, mortised surface. The method is fully carried out by hanging a door member within said door opening by attaching connective hinge means on a vertical edge of said door to the hinge plate means.

The foregoing, and other objects, advantages, and characterizing features of this invention, will become clearly apparent from the following description of certain illustrative embodiments thereof, considered along with the accompanying drawings, where like references numerals signify like elements thoughout various figures.

DESCRIPTION OF THE PREFERRED EMBODIMENT

Figure 1:
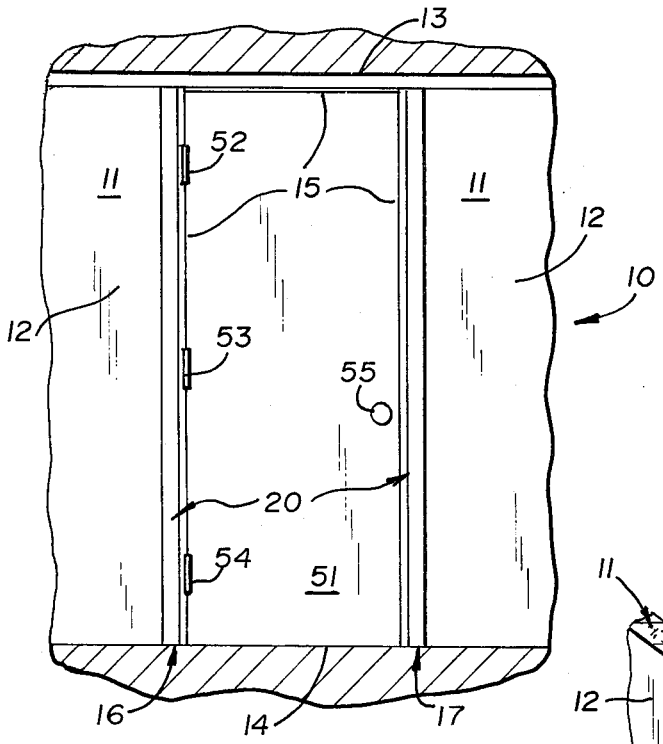
FIG. 1 is an elevational view of a hollow-wall partition having a framed door opening in accordance with the invention.

Turning first to FIG. 1, there is shown, in elevational view, hollow-wall partition 10. This construction is of conventional design, having two spaced-apart rows of panels 11 with exposed wall face surfaces 12. The hollow-wall partition 10 extends from ceiling 13 to floor 14. Door opening 15, having a vertical side 16 and an opposite vertical side 17, is provided for a full room height from floor 14 to ceiling 13. In the preferred embodiment of this invention, a door frame assembly 20 provides framing means from the floor 14 to the ceiling 13, but within the scope of the invention, may also be provided at door openings which extend for less than full floor-to-ceiling height and have conventional header means extending across an upper horizontal span of the door opening. In the preferred embodiment, ceiling 13 includes a conventional runner traversing the upper horizontal span of the door opening, which abuts upper ends of door frame assembly 20. FIG. 1 also shows a door member 51 hung within door opening 15 and being attached to door frame assembly 20 at side 16 by conventional connective attachment hinge means 52, 53, and 54. At opposite side 17, door member 51 has conventional locking means 55, which coacts with the door frame assembly 20 at side 17 of door opening 50. In accordance with this invention, door frame assembly 20 comprises interchangeable elements wherein in a particular building construction, a door frame assembly 20 may be utilized at a multiplicity of such door openings by the unique interchangeable elements provided.

Figure 2:
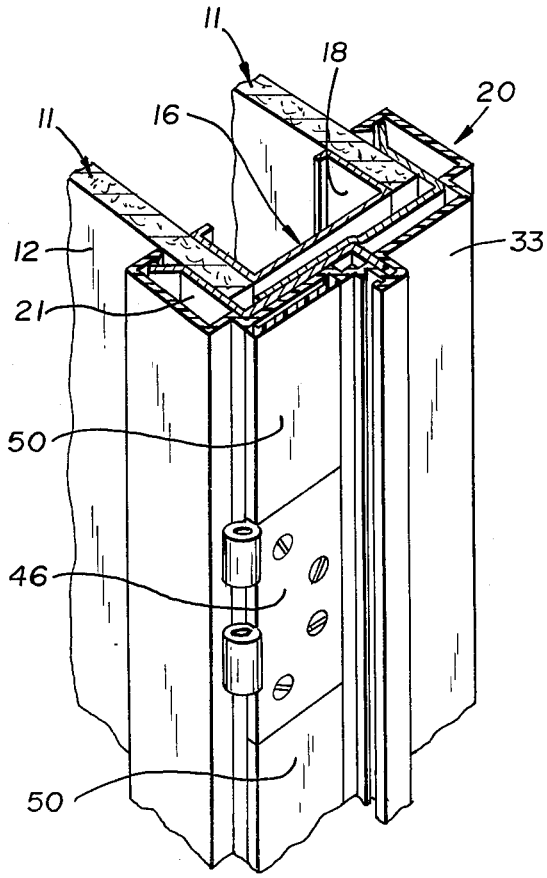
FIG. 2 is a partial perspective view of one side of the door opening shown in FIG. 1 comprising the hinge side of the doorframe.
Figure 3:
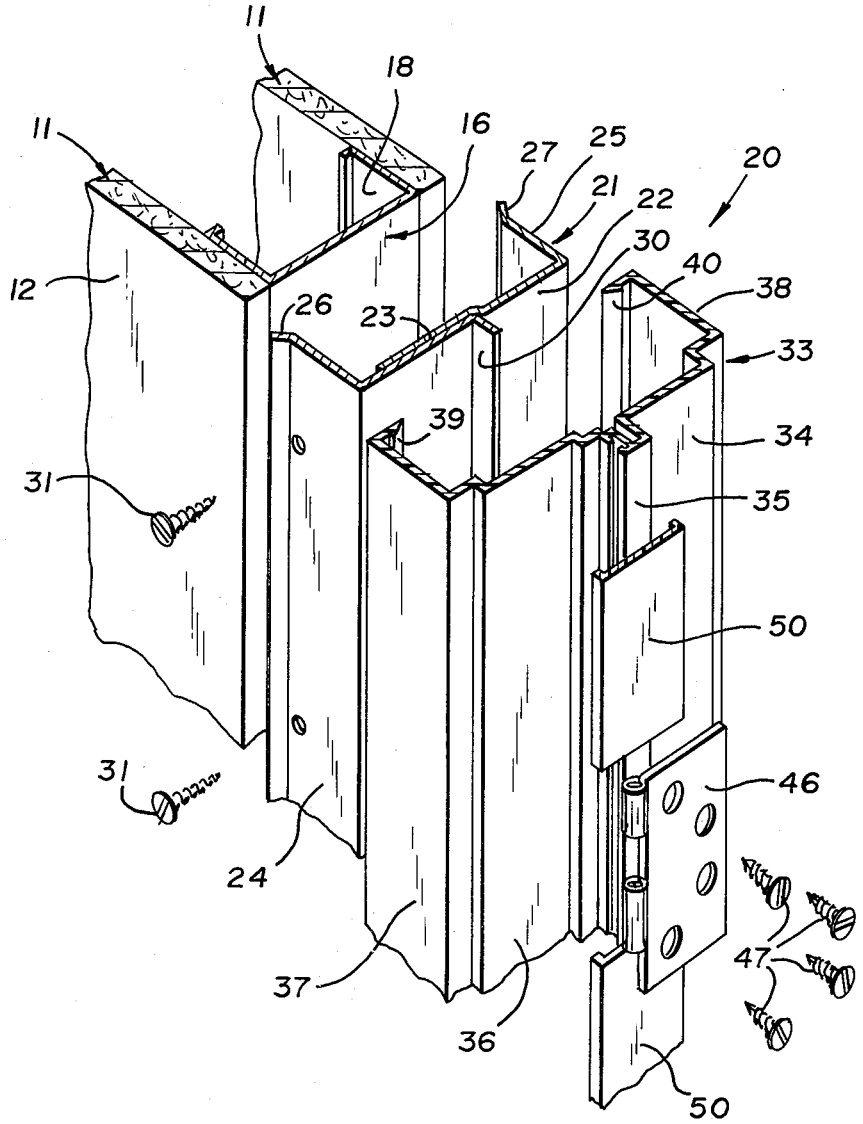
FIG. 3 is an exploded view of the doorframe shown in FIG. 2.

FIGS. 2 and 3 illustrate side 16 of door frame assembly 20. Side 16, in the illustration, comprises the hinge side of door opening 15. FIG. 2 presents elements of door frame assembly 20 in their functionally connected formation. A vertical stud member 18, having a conventional channel shape used in hollow-wall construction, is spaced adjacent side 16 at the ends of panels 11, providing wall and doorframe support adjacent door opening 15. In the preferred embodiment, stud 18 comprises a metal channel, but within the range of this invention other utile construction materials, such as wood, may comprise the stud. Positioned extending along side 16 is metal backer jamb member 21 in the preferred embodiment of this invention. Snap-engaged to metal backer jamb member 21 is vinyl jamb member 33, which conceals and envelops metal backer jamb member 21 by covering it from view. With this manner of engagement, metal backer jamb member 21 need not extend for the full height between floor 14 and ceiling 13, and may be provided to stop short of the ends of a door opening. A shorter metal backer jamb member 21 may be used whether there is a full, or less than full, room-height door opening. In the preferred embodiment disclosed, a solid-core door member 51 is shown. It is accordingly preferred that metal backer jamb member 21 extend to contact floor 14 to provide additional door support by bearing on the floor. Since vinyl jamb member 33 is provided for the full height of door opening 15, it will provide an esthetically pleasing jamb surface whether metal backer jamb member 21 extends for the full height or less than full height. Hinge plate means 46 is shown attached to vinyl jamb member 33 and is flanked above and below by mortising vinyl trim 50 in accordance with the preferred embodiment of the invention.

Turning now to FIG. 3, an exploded perspective view of the embodiment shown in FIG. 2 is depicted. Metal backer jamb member 21 is provided with a generally U-shape having a web portion 22 and free legs 24 and 25 extending therefrom to form the generally U-shape. Free legs 24 and 25 respectively terminate in lip portions 26 and 27 providing snap-engageable means. Screw fasteners 31 attach free legs 24 and 25 to wall face surfaces 12. Screw fasteners 31 are preferably provided as being self-drilling screws well known to the construction industry. A characterizing feature of metal backer jamb member 21 is thicker web portion 23 provided along a portion of web portion 22 and extending for the full length of metal backer jamb member 21. A thicker attachment surface is desirable in order to provide a screw-attachable surface for screw-attaching hinge plates which supports door member 51. The channel-shaped stud member 18 at side 16 opens inward and has the web of the channel at the edges of the panels 11, abutting the back of web portion 22. In an alternate preferred embodiment for the invention, stud member 18 opens outwardly. A generally centrally located inturned leg portion 30 runs adjacent thicker web portion 23 and extends for the full length of metal backer jamb member 21. Inturned leg portion 30 is provided to project inward into later-described doorstop portion 35 of snap-engaged vinyl jamb member 33 for rigidity along the length of doorstop portion 35.

Continuing with FIG. 3, vinyl jamb member 33 is shown having a generally U-shape. Vinyl jamb member 33 is preferably an extruded rigid vinyl well suited to door-framing construction. Vinyl jamb member 33 has body portion 34 with doorstop portion 35 being upraised from body portion 34 and having a hollow configuration wherein inturned leg portion 30 projects for additional rigidity. Running the length of body portion 34 there is provided a longitudinal recess 36 positionally corresponding with thicker web portion 23. Longitudinal recess 36 provides an attachable surface for hinge plate means 46, positioned thereon. At opposite edges of body portion 34 are flanges 37 and 38 projecting therefrom to form the generally U-shape. Flanges 37 and 38 terminate in inturned nib portions 39 and 40. The length of flanges 37 and 38 extend to register with lip portions 26 and 27 of free legs 24 and 25 permitting snap-engagement between the inturned nib portions 39 and 40 with these lip portions 26 and 27. Thereby, vinyl jamb member 33, as described, conceals and is supportingly engaged to, metal backer jamb member 21. The conventional hinge plate means 46 reside along longitudinal recess 36 for connective attachment with conventional hinge means 52, 53, and 54 of door member 51. Hinge plate means 46 are fastened by means of conventional fasteners such as self-drilling screws 47 which penetrate vinyl jamb member 33 and screw-attach to thicker web portion 23 of metal backer jamb member 21. Typically, two to four hinge connections support door members in hollow-wall partition construction, but it is within the purview of this invention to be adaptable for use with any normally reasonable number of hinges. Hinge plate means 46, in the preferred embodiment shown, is provided at three locations along longitudinal recess portion 36 in correspondence with, and attached to, said three hinge means 52, 53, and 54 which are affixed along an edge of door member 51.

Flanking hinge plate means 46 is mortising vinyl trim 50 having a thickness substantially the same as hinge plate means 46. A generally planar finished surface is thereby provided. Mortising vinyl trim may be quickly field-cut for each of installation and size adaptability during erection of door frame 20. The mortising vinyl trim 50 is adhered to longitudinal recess 36 by adhesive material. Well-known adhesive materials may be used to facilitate this attachment such as synthetic resins or nitryl rubber. A feature of longitudinal recess 36 is the ability of an installer to vary locations of hinge plate means 46 therealong. The use of mortising vinyl trim 50 above and below hinge plate means 46 complements such hinge installation because it may be readily field cut to accommodate spacing requirements above and below hinge plate means 46 however located.

Figure 4:
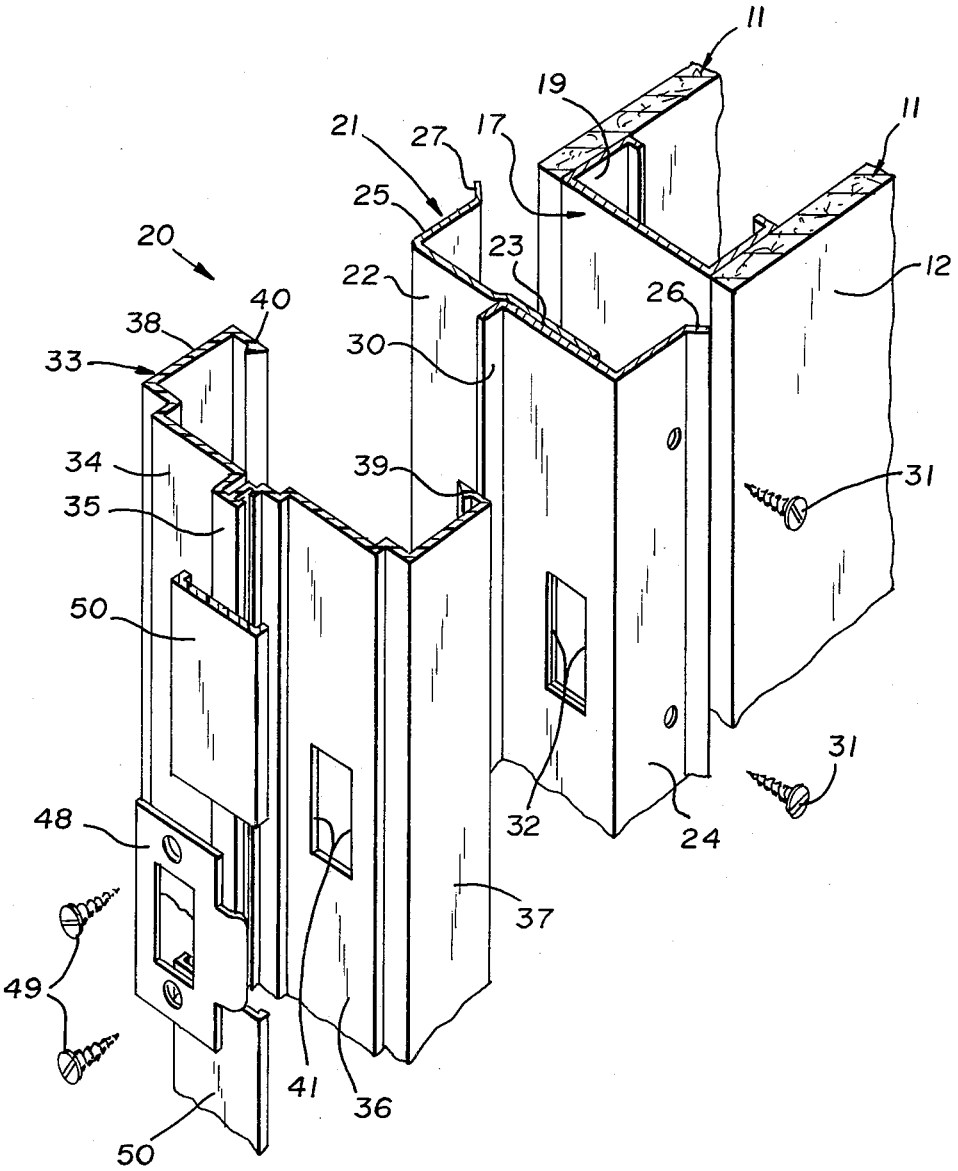
FIG. 4 is an exploded, partial perspective view of the opposite side of the door opening, comprising the strike plate side of the doorframe in accordance with this invention.

The exploded perspective view illustrated in FIG. 4 shows door frame assembly 20 at side 17 of door opening 15. This is the strike plate side 17 of the door opening opposite the hinge side 16 wherein door bolts, latches, and the like, may be provided on door member 51. Similar to 16, side 17 provides stud member 19 adjacent side 17 spaced between panels 11 at their end. Panels 11 have wall face surfaces 12, which are engaged by screw fasteners 31 securing free legs 24 and 25 of metal backer jamb member 21 thereto.

In the preferred embodiment, metal backer jamb members 21 at strike plate sides of door openings are provided with one, or multiplicity of cutout portions 32 during manufacture. Conventional construction techniques desirably envision interchangeable doorframes for use in a particular building or factory construction wherein a particular standard for the positioning of door locking means and stirke plate means is normally provided. In providing a cutout portion 32 at a predetermined standard height for such construction the elements of door frame assembly 20 may be interchangeably used throughout such a building. It is to be noted that in the preferred embodiment metal backer jamb members 21 at strike plate sides of a door do not extend for the full height of door opening 15, and thus, where a particular alteration or variance is required, the metal backer jamb member 21 may be moved upward or downward to position a cutout portion 32 at proper vertical correspondence with door locking and strike plate means. Moreover, field cutting of additional slotting may be accomplished with conventional tools. Another desirable alternative embodiment provides a multiplicity of cutout portions 32, or longer cutout portions, through thicker web portion 23 whereby metal backer jamb member 21 would be adaptable to multiple door framing requirements when more than one standard-height door locking means is envisioned in a particular building construction.

FIG. 4 illustrates vinyl jamb member 33 snap-engagable with metal backer jamb member 21. Being reversible, vinyl jamb members 33 may be snap-engaged interchangeably at either side 16 or 17. An additional feature is shown for the preferred embodiment illustrated in FIG. 4 (and is also provided at side 16 but not shown in FIGS. 2 and 3). This feature is cutout slot 41, in positional correspondence with strike plate means 48, adapted for coactive engagement by a door locking means 55. Cutout slot 41 may be precut at a predetermined height at the factory, corresponding to the precutting of cutout portion 32, or may easily be field cut. Because mortising vinyl trim 50 covers longitudinal recess 36, precutting multiple cutout slots 41 presents no problem because longitudinal recess 36 will be concealed by the mortising vinyl trim 50 upon installation. Thus it is seen that the conbination of metal backer jamb members 21 with vinyl jamb members 33 provides interchangeable elements when either a single standard height for door locking means is required or where positional variations become necessary. The affixation of strike plate means 48 is facilitated by the use of screw fasteners 49 which extend through longitudinal recess 36 for engagement with the thicker web portion 23 of metal backer jamb member 21. Strike plate means 48 is of a conventional shape utilized in the building construction industry but may have other shapes and sizes in conformance with construction procedures. The shapes of cutout portions 32 and cutout slots 41 are generally rectangular in the preferred embodiment but with the scope of the invention may be cut out to conform to particularly shaped locking means bolt shapes and sizes. Strike plate means 48 preferably extends sufficiently above and below cutout portions 32 and cutout slots 41 in order to permit screw fasteners 49 to engage uncut surfaces of thicker web portion 23. Mortising vinyl trim 50 is provided, flanking strike plate means 48 above and below, along longitudinal recess 36. Thereby, longitudinal recess 36 is concealed from view upon final installation and provides a finished trim appearance having a generally planar surface.

Figure 5:
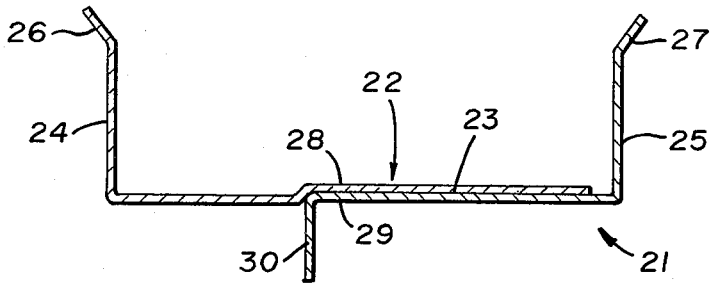
FIG. 5 is a cross-sectional view of the preferred embodiment for the metal backer jamb member of the door frame assembly in accordance with this invention.

In the preferred construction, metal backer jamb member 21 is provided in accordance with the illustration shown in FIG. 5. This embodiment is depicted in cross-sectional view. In this preferred form, metal backer jamb member 21 is comprised of two elements having a generally L-shaped with free legs 24 and 25, and overlapping legs 28 and 29. At one side of metal backer jamb member 21 free leg 24 terminates in an overlapped leg 28 a portion of which overlaps a portion of overlapped leg 29 being similarly connected to free leg 25. The overlap portion forms thicker web portion 23 wherein the non-overlap portion fills out the remainder of web portion 22. Overlapped leg 29 terminates in inturned leg portion 30 shown extending therefrom at generally right angles. The material preferably comprising metal backer jamb member 21 is 22-gauge galvanized steel (0.030 inches). And therefore the thickness of thicker web portion 23 would be approximately 0.060 inches providing sufficient thickness for hinge attachment by self-drilling screws capable of supporting hollow-core doors and solid-core doors ranging up to about 100 lbs. The material comprising metal backer jamb member 21, when utilizing galvanized steel, may range in thickness of from about 0.022 inches to about 0.052 inches. Sufficient strength and stability is provided within this range for adaptation with conventional door framing untilizing both hollow and solid-core doors presently available. In an alternate preferred embodiment for the material comprising metal backer jamb member 21, it is envisioned that extruded aluminum be utilized. When utilizing extruded aluminum, web portion 22 of metal backer jamb member 21 would not have overlapped legs 28 and 29 but would rather have thicker web portion 23 being a solid extruded portion thicker than remaining portions of metal backer jamb member 21. When untilizing extruded alumnum it is envisionsed that the thickness be preferably 0.062 inches generally throughout and a thickness at thicker web portion 23 of about 0.125 inches. Suitable thicknesses usable for the practice of this invention utilizing extruded aluminum range from about 0.040 inches to about 0.075 inches generally throughout and from about 0.080 inches to about 0.150 inches at thicker web portion 23.

In FIG. 5, the preferred embodiment utilizing two L-shaped members with overlapping legs, an integral metal backer jamb member 21 is provided, because overlapped legs 28 and 29 are preferably spot welded to integrate the overlapped legs thereby providing a one-piece integral metal backer jamb member 21.

Figure 6:
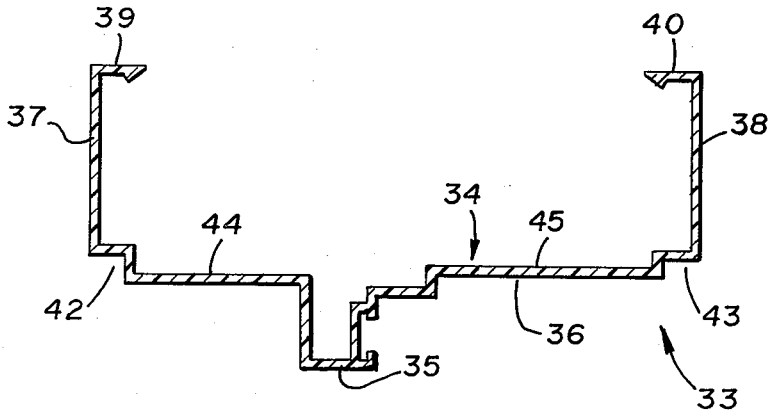
FIG. 6 is a cross-sectional view of the preferred embodiment for the vinyl jamb member of the doorframe assembly in accordance with this invention.

FIG. 6 illustrates, in cross-sectional view, the preferred embodiment for vinyl jamb member 33. It is envisioned as being extruded rigid vinyl having a wall thickness of generally 0.062 inches but may be provided in thicknesses of from about 0.040 to about 0.080 inches within the scope of the invention. Body portion 34 connects flanges 37 and 38 which extend generally at right angles therefrom and form the generally U-shape of the member. Flange 37 terminates in inturned nib portion 39 and flange 38 terminates in inturned nib portion 40. These inturned nib portions 39 and 40 provide the snap-engagable means which are adapted to engage the lip portions 26 and 27 of metal backer jamb members 21. In its preferred form, vinyl jamb member 33 comprises notches 42 and 43 at the junction of flanges 37 and 38 with body portion 34. Notches 42 and 43 form back surfaces 44 and 45 which are adapted to abut web portion 22 of metal backer jamb member 21 for additional strength and rigidity along the abutment of these surfaces. This notching also protects door frame assembly 20 from abuse which may be caused by the frame experiencing impact during normal pedestrian traffic through door opening 15. Body portion 34 is also provided with a doorstop portion 35 located generally centrally thereon. Doorstop 35 is upraised from body portion 34 and provides a hollow back into which inturned leg portion 30 of metal backer jamb member 21 extends for rigidity and support therebehind. Along one side of doorstop 35, running the full length of body portion 34, resides longitudinal recess 36. Longitudinal recess 36 is designed for attachment with hinge plate means 46 and strike plate means 48 positioned thereon. The depth of longitudinal recess 36 is provided to correspond with conventional thicknesses of hinge plate means and strike plate means. This thickness of course may be altered with respect to particular construction requirements. With reference to FIGS. 4 and 6, a cutout slot 41 may be provided along longitudinal recess 36 at a predetermined, or standardized, height for positioning in correspondence with strike plate means 48, and locking means 55 of door member 51. The cutout slot 41 may be simple field cut with conventional tools to remove a portion at the required height. Additionally, a multiplicity of cutout slots 41 may be provided at spaced apart intervals for use in a building construction wherein different door locking means positions are specified. Since vinyl mortising trim 50 is applied for the full length of longitudinal recess 36, flanking hinge plate means 46 and strike plate means 48, all cutouts would be hidden from view upon final installation with the mortising vinyl trim 50 providing a generally planar finished surface above longitudinal recess 36. The construction preferred for vinyl jamb member 33 snap-engages with the metal backer jamb members 21 and envelops, or conceals, all exposed surfaces of the metal backer jamb members 21. Suitable colors for the extruded rigid vinyl may be utilized as particular needs arise. The finished appearance of such extruded rigid vinyls utilized in conjunction with this invention provides a new and novel snap-on engagement construction for door frame assemblies in which three basic elements are required, namely: metal backer jamb member 21; vinyl jamb member 33; and, mortising vinyl trim 50. In combination with conventional hinge plate means 46, and strike plate means 48, door framing in hollow-wall partition construction may be fully accomplished with the disclosed invention featuring field adaptibility, interchangeability, reversibility, low material cost and facile time-saving installation.

Figure 7:
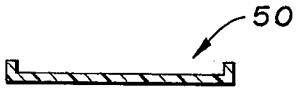
FIG. 7 is a cross-sectional view of the preferred embodiment for the mortising vinyl trim of the door frame assembly in accordance with this invention.

With reference to FIG. 7, the preferred embodiment for mortising vinyl trim 50 is shown. It is generally provided as a rectangular strip with short stub end portions providing a space therebetween for positioning of adhesive material when adhering to longitudinal recesses 36. Mortising vinyl trim 50 may be field-cut, or precut, for use in the portions of longitudinal recesses 36 between, and flanking, hinge plate means 46, and strike plate means 48, attached to vinyl jamb member 33. Adhesive materials such as synthetic resins or nitryl rubbers are particularly suited for this attachment. In the preferred embodiment a nitryl rubber is envisioned.

Door frame assembly 20, disclosed in the preferred embodiment, is preferably utilized in full room door openings from ceiling to floor and being of a conventional height of about 8½ feet to about 10 feet with typical increments of 6 inches therebetween. However, it is within the spirit and scope of this invention to provide a door frame assembly 20 at less than full room height door openings wherein conventional header means is abutted by the upper portions of vinyl jamb members 33. Well-known adaptable shapes, and header members, may be utilized at this point. In particular, an extruded vinyl header member having a generally U-shape substantially identical to vinyl jamb member 33 may be used wherein the juncture therebetween may be a mitred joint. In the preferred embodiment, a conventional ceilng runner is provided for accommodating the abutment of an upper end of vinyl jamb members 33. Along such upper portion, a horizontal doorstop is envisioned and positionally matches doorstop portions 35 for proper door closure.

The pre-cutting of cutout portions 32 on metal backer jamb members 21 used at strike plate sides of door openings permits the members to be positioned as needed along the strike plate side of a door opening wherein the metal backer jamb member may be vertically shifted to positionally correspond with a cutout portion 32 for strike plate and door locking means. Because metal backer jamb member 21 is provided preferably in a length less than the full height of the door opening, the shifting feature to accommodate particular construction height requirements allows desirable adaptability.

Thus it is apparent that there has been provided, in accordance with the invention, a door frame assembly for use in hollow-wall partition construction that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A doorframe assembly comprising in combination:

metal backer jamb members adapted for attachment to opposite sides of a door opening, said members being of substantially the same structural shape having a web portion connecting two free legs forming a generally U-shape wherein a portion of the web is thicker than remaining portions, said free legs of the U-shape being adapted for fastening at opposite wall face surfaces adjacent a door opening, the free legs terminating in lip portions wherein at least one metal backer jamb member has a cutout portion, adapted for coaction with door locking means, located along the thicker web portion;

vinyl jamb members snap-engaged with the metal backer jamb members, said vinyl jamb members being of substantially the same structural shape having a generally U-shape comprising a body portion covering the web portion of the metal backer a generally U-shape comprising a body portion covering the web portion of the metal backer members and a centrally located upraised door stop portion along said body portion, said body portion also having a longitudinal recess portion, said body portion having flanges extending from opposite ends thereof, the flanges terminating in inturned nib portions snap-engaging the lip portions of the metal backer jamb member whereby said metal backer jamb member is enveloped by said vinyl jamb member snap-engaged thereto;

hinge plate means for supporting a door, said hinge plate means attached along the longitudinal recess of a vinyl jamb member at a side of a door opening;

a strike plate means for receiving door locking means, said strike plate means attached in positional correspondence with a cutout portion of a metal backer jamb member along the longitudinal recess of a vinyl jamb member adapted for positioning at a side of a door opening opposite the vinyl jamb member having the hinge plate means;

mortising vinyl trim adhered along remaining open portions of the longitudinal recesses of the vinyl jamb members, said trim having a thickness substantially the same as the hinge plate means and strike plate means providing a mortised generally planar finished surface along the vinyl jamb members; and wherein the web portion of the metal backer jamb members comprises a centrally located inturned leg portion positionally corresponding with the door stop portion of the snap-engaged vinyl jamb member wherein said inturned leg extends inwardly of the door opening and projects into the upraised door stop portion.

2. A doorframe assembly as claimed in claim 1 wherein the vinyl jamb member adapted for installation at the strike plate means side of a door opening, has a cutout slot along the longitudinal recess in positional correspondence with said strike plate means for coaction with door locking means.

3. A doorframe assembly as claimed in claim 1 wherein the hinge plate means and strike plate means are fastened along said longitudinal recesses by means of self-drilling screws penetrating the vinyl jamb member and engaging the thicker web portion of said metal backer jamb member.

4. A doorframe assembly as claimed in claim 1 wherein the mortising vinyl trim is adhered to the vinyl jamb members by synthetic resin adhesive material.

5. A doorframe assembly as claimed in claim 1 wherein the mortising vinyl trim is adhered to the vinyl jamb members by nitrile rubber adhesive material.

6. A doorframe assembly as claimed in claim 1 wherein at least one metal backer jamb member extends for less than the full height of the vinyl jamb members.

7. A doorframe assembly as claimed in claim 1 wherein the thicker web portion of the metal backer jamb members has a thickness of from about 0.044 inches to about 0.150 inches and the remaining portions have a thickness of from about 0.022 inches to about 0.075 inches.

8. a doorframe assembly as claimed in claim 7 wherein the metal backer jamb member comprises two L-shaped steel members integrally connected along overlapped leg portions forming the generally U-shape and forming the thicker web portion at said overlapped leg portions.

9. A doorframe assembly as claimed in claim 7 wherein the metal comprising the metal backer jamb is extruded aluminum.

10. In combination:

a hollow wall partition construction having two spaced apart rows of wall panels with opposite wall face surfaces;

a door opening in said hollow wall partition construction having vertical stud members positioned adjacent opposite sides of the door opening;

metal backer jamb members at opposite sides of said door opening, said members being of substantially the same structural shape having a web portion connecting two free legs forming a generally U-shape wherein a portion of the web portion is thicker than remaining portions, said metal backer jamb members fastened at opposite wall face surfaces by means of fasteners attaching the free legs of said U-shape to said wall face surfaces, said free legs terminating in lip portions projecting outwardly from said wall face surfaces wherein at least one cutout portion adapted for coaction with door locking means is located along the thicker web portion of at least one metal backer jamb member;

vinyl jamb members snap-engaged to said metal backer jamb members, said vinyl jamb members being of substantially the same structural shape having a generally U-shape comprising a body portion covering the web portion of the metal backer jamb member, said body portion having a centrally located upraised door stop portion, a longitudinal recess portion, flanges extending from opposite sides of the body portion extending over the free legs of the metal backer jamb member, and terminating in inturned nib portions snap-engaging the lip portions of said free legs whereby the vinyl jamb member envelops the metal backer jamb member;

hinge plate means attached along the longitudinal recess of a vinyl jamb member at one side of said door opening;

strike plate means attached in positional correspondence with said cutout portion of the metal backer jamb member along the longitudinal recess of the vinyl jamb member opposite said hinge means side of said door opening;

mortising vinyl trim adhered along remaining open portions of the longitudinal recesses, said trim having a thickness substantially the same as the hinge plate means and strike plate means providing a mortised generally planar finished surface; and, a door member supported within said door opening by hinge means connective attachment along an edge thereof to said hinge plate means; and wherein the web portion of the metal backer jamb members comprises a centrally located inturned leg portion positionally corresponding with the door stop portion of the snap-engaged vinyl jamb member wherein said inturned leg extends inwardly of the door opening and projects into the upraised door stop portion.

11. The combination according to claim 10 wherein the metal backer jamb member and vinyl jamb member at the strike plate means side of the door opening have cutouts slots in positional correspondence with said strike plate means for coaction with door locking means.

12. The combination according to claim 10 wherein the metal backer jamb member comprises two L-shaped steel members integrally connected along overlapped leg portions forming the generally U-shape and forming the thicker web portion at said overlapped leg portions.

13. The combination according to claim 10 wherein the metal backer jamb member comprises extruded aluminum.

14. The combination according to claim 10 wherein the hinge plate means and strike plate means are fastened along said longitudinal recesses by means of self-drilling screws penetrating the vinyl jamb member and engaging the thicker web portion of the metal backer jamb members.

15. The combination according to claim 10 wherein the mortising vinyl trim is adhered to the vinyl jamb members by synthetic resin adhesive material.

16. The combination according to claim 10 wherein the mortising vinyl trim is adhered to the vinyl jamb members by nitrile rubber adhesive material.

17. The combination according to claim 10 wherein at least one metal backer jamb member extends for less than the full height of the door opening.

18. A method of installing a doorframe assembly in a door opening in a hollow wall partition construction having vertical stud members adjacent opposite sides of the door opening and header means across the top of the door opening, said metod comprising the steps of:

attaching generally U-shaped metal backer jamb members having substantially the same structural shape to opposite sides of said door opening by means of screw fasteners extending through legs of the metal backer jamb members engaging opposite wall face surfaces wherein at least one metal backer jamb member has a cutout portion adapted for coaction with door locking means;

snap-engaging generally U-shaped vinyl jamb members having substantially the same structural shape over said metal backer jamb members by means of nib portions located on flanges of the U-shaped vinyl jamb members snap-engaging lip portions on metal backer jamb member leg portions;

attaching hinge plate means along a longitudinal recess portion of a vinyl jamb member at one side of the door opening by means of screw fasteners extending through the vinyl jamb member and engaging the metal backer jamb member;

removing a cutout slot on the longitudinal recess portion of the vinyl jamb member opposite the hinge means side of the door opening in positional correspondence with said cutout portion of the metal backer jamb member;

attaching strike plate means at the cut-out slot portion along said longitudinal recess by means of screw fasteners extending through the vinyl jamb member and engaging the metal backer jamb members;

adhering vinyl mortising trim along the longitudinal recesses of the vinyl jamb members at remaining open portions by means of applying adhesive material between said trim and longitudinal recesses wherein said trim having a thickness substantially the same as the hinge plate means and strike plate means whereby a substantially planar mortised surface is provided; and, having a door member in said door opening by attaching connective hinge means on a vertical edge of said door member to said hinge plate means, wherein said door member has locking means on an opposite vertical edge capable of coacting with said strike plate means to provide locking engagement thereby.

19. The method according to clam 18 wherein the step of adhering the vinyl mortising trim comprises applying nitrile rubber adhesive material.

20. The method according to claim 18 wherein the step of adhering the vinyl mortising trim comprises applying synthetic resin adhesive material.

21. The method according to claim 18 wherein the step of attaching the metal backer jamb members comprises attaching at least one of said members for less than the full height of the door opening.

* * * * *